US009254559B2

(12) United States Patent
Berger et al.

(10) Patent No.: US 9,254,559 B2
(45) Date of Patent: Feb. 9, 2016

(54) DRILL HAMMER AND/OR IMPACT HAMMER HAVING FREE CONVECTION COOLING

(75) Inventors: Rudolf Berger, Grünwald (DE); Helmut Braun, Bergkirchen (DE)

(73) Assignee: Wacker Neuson Produktion GmbH & Co. KG, Munich (DE)

( * ) Notice: Subject to any disclaimer, the term of this patent is extended or adjusted under 35 U.S.C. 154(b) by 736 days.

(21) Appl. No.: 13/520,471

(22) PCT Filed: Jan. 13, 2011

(86) PCT No.: PCT/EP2011/000126

§ 371 (c)(1),
(2), (4) Date: Jul. 3, 2012

(87) PCT Pub. No.: WO2011/085986

PCT Pub. Date: Jul. 21, 2011

(65) Prior Publication Data

US 2013/0118768 A1 May 16, 2013

(30) Foreign Application Priority Data

Jan. 15, 2010 (DE) ..... 10 2010 004 723

(51) Int. Cl.
*B25D 17/20* (2006.01)
*B25D 9/10* (2006.01)

(52) U.S. Cl.
CPC *B25D 17/20* (2013.01); *B25D 9/10* (2013.01); *B25D 2217/0061* (2013.01); *B25D 2250/121* (2013.01); *B25D 2250/245* (2013.01)

(58) Field of Classification Search
CPC ... B25D 2217/0061; B25D 17/20; B25D 9/10
USPC ..... 173/90, 200, 204
See application file for complete search history.

(56) References Cited

U.S. PATENT DOCUMENTS 1,911,813 A 5/1933 Decker
1,934,935 A 11/1933 Luxmore
2,609,813 A * 9/1952 Maurer et al. ..... 173/118

(Continued)

FOREIGN PATENT DOCUMENTS

CH 110 334 A 6/1925
DE 30 35 351 A1 6/1982

(Continued)

OTHER PUBLICATIONS

International Search Report for PCT/EP2011/000126, Dated Apr. 27, 2011.

*Primary Examiner* — Michelle Lopez
(74) *Attorney, Agent, or Firm* — Boyle Fredrickson, S.C.

(57) ABSTRACT

The invention relates to a percussion tool having an internal combustion engine and a hammer mechanism that can be driven by the internal combustion engine by means of a transmission. A part of the engine housing, the transmission housing, or the impact hammer mechanism housing is enclosed by a cover. The cover is spaced at a distance from the remainder of the machine, so that a gap is present between the cover and the remainder of the machine. Cooling air can flow into the gap at the lower face of the cover and flow back out via a flue and an opening. The components beneath the cover are thereby effectively cooled, even without an additional cooling air blower.

15 Claims, 2 Drawing Sheets

(56) References Cited

U.S. PATENT DOCUMENTS

| | | | |
|---|---|---|---|
| 2004/0211808 | A1 | 10/2004 | Rosenbaum et al. |
| 2006/0131042 | A1 | 6/2006 | Hammerstingle et al. |
| 2010/0253162 | A1 | 10/2010 | Sakamaki et al. |

FOREIGN PATENT DOCUMENTS

| | | | |
|---|---|---|---|
| DE | 20 2004 006553 | U1 | 7/2004 |
| GB | 255 519 | A | 7/1926 |
| JP | 2005 193310 | A | 7/2005 |

* cited by examiner

DRILL HAMMER AND/OR IMPACT HAMMER HAVING FREE CONVECTION COOLING

BACKGROUND OF THE INVENTION

1. Field of the Invention

The invention relates to a percussion tool, such as a drill hammer and/or impact hammer, having an internal combustion engine.

2. Discussion of the Related Art

Percussion tools, including drill hammers and/or impact hammers having an internal combustion engine, referred to hereinafter as hammers for short, are known in particular to be relatively heavy breaker hammers, with which work is carried out in a substantially vertically downward direction. Due to the internal combustion engine, a striking mechanism, in particular a pneumatic spring striking mechanism, can be driven via a transmission and acts on a tool, for example drill bit. In petrol hammers of this type, a cooling air fan driven by the crankshaft of the internal combustion engine is provided to cool the engine. The cooling air fan generates a cooling air flow, which is guided along the outer side of the engine housing, that is to say of the cylinder of the internal combustion engine, in particular along the cooling ribs provided on the outer side of the cylinder.

The striking mechanism driven by the internal combustion engine and provided to generate the working motion of the hammer may also be heated intensely due to the air compression, in particular if the striking mechanism is a pneumatic spring striking mechanism. To cool the striking mechanism, it is therefore known to provide an additional fan wheel, which generates a separate cooling air flow for the striking mechanism. Corresponding installation space has to be provided for this additional fan wheel, thus increasing the complexity of the construction.

The principle of active cooling with the aid of forced convection on the basis of cooling air flows, which have been generated by cooling fans, has proven its worth in practice. However, there may be a problem in the fact that the active cooling does not function if the device is switched off. In particular, individual components of the hammer, for example the cylinder, the exhaust gas system, or the striking mechanism, are heated very intensely during operation. If the hammer is switched off and cooling no longer functions, the heat present distributes throughout the entire device, and therefore components which were not heated to a large extent during operation are also heated considerably. The temperature differences within the hammer become balanced over time, which leads to undesired intense heating of previously cool components. The temperature of the device only decreases gradually, and slowly overall, to ambient level.

The tank, fuel-guiding parts, and also the carburetor are included in particular among the parts which are cooler during operation. These components heat up considerably once the device has been switched off, which increases the tendency for the formation of vapor bubbles in the fuel. Start-up of the engine if the device is hot and after only a short break can be impaired, which, at the least, restricts the comfort for the operator.

An impact tool having an internal combustion engine is described in CH 110 334 A. A flywheel has blade-like spokes, with which a forced cooling air flow is produced. The cooling air flow is drawn beneath a sleeve through grooves so as to cool the engine.

Another impact tool is described in GB 255 519, in which the exhaust gas of an internal combustion engine is diverted via a nozzle. The exhaust gas flow entrains a cooling air flow, which is guided via a sleeve to cool the engine.

A hammer having a protective hood is known from DE 30 35 351 A1, said protective hood covering the hammer above, at the front and at the sides. The engine is left open so as to allow cooling thereof. The protective hood is located on the whole at a distance from the actual hammer and is cushioned against the hammer by means of springs.

U.S. Pat. No. 1,934,935 A describes an internal combustion engine in which cooling ribs are enclosed by a casing. The casing has openings in its lower and upper regions, whereby cooling air can flow in through said openings and can exit therefrom.

SUMMARY OF THE INVENTION

The object of the invention is to provide a drill hammer and/or impact hammer, in which undesired intense heating of components which are relatively cool during operation of the hammer is prevented or at least reduced once the hammer has been switched off.

The object is achieved in accordance with the invention by a percussion tool having an internal combustion engine with an engine housing, a striking mechanism, which can be driven by the internal combustion engine and which has a striking mechanism housing, a transmission, which is arranged operatively between the internal combustion engine and the striking mechanism and which has a transmission housing, and a hood surrounding at least part of the engine housing, the transmission housing, and/or the impact mechanism housing in a region. In this region, the hood is spaced from the part which it surrounds in such a way that a gap is provided between the part in question and the hood. The gap is open at its lower side towards the ambient environment, based on a primary working direction of the drill hammer and/or impact hammer. The hood has an opening in its upper side, wherein the gap and the opening are communicatively interconnected and form a cooling air duct, in such a way that ambient air can flow in via the lower side of the gap in the form of cooling air and can flow out again via the opening.

The hood thus forms a cooling air duct in cooperation with the components which it surrounds, that is to say a part of the engine housing, of the transmission housing, and/or of the striking mechanism housing. The cooling air duct in particular has an inlet in the lower side of the hood or at the downwardly open gap, as well as the gap itself—formed between the hood and the components surrounded thereby, and lastly the opening, serving as an outlet, in the upper side of the hood.

Due to the fact that the components surrounded by the hood are heated intensely during operation of the hammer, the air in the cooling air duct, that is to say in the gap, is also heated. The heating of the air causes the air to rise upwardly and ultimately to exit through the opening in the upper side of the hood. Cool air from the ambient environment flows in via the inlet in the lower side of the hood to the same extent as heated air exits at the opening, and cools the heated components. At the same time, the cooling air flow stops heat being transferred from the hot components to cooler components arranged outside the hood. The cooler components are thus also cooled additionally, or are at least protected from a stronger heating effect.

The cooling air flow generated merely by the heating of the air in the gap causes cooling by free convection, without having to provide a cooling air fan. This has the advantage that the hammer can also be cooled if the internal combustion engine and the cooling air fan provided therewith as standard are not in operation. Cooling as a result of the cooling air flow in the gap is also effective in the idle phase of the hammer, when the engine is switched off.

The different housings, namely the engine housing, transmission housing, and striking mechanism housing, do not have to be formed separately or distinguishably. It is quite possible, for example, to integrate the transmission in the engine or in the striking mechanism. In this regard, like housing component parts may also serve functionally as a housing for a number of sub-components of the hammer.

The hood can surround the region to be cooled in a tent-like manner. In particular, the hood can be drawn over the components to be cooled, from above.

The opening provided in the upper side of the hood may be formed at the end of a flue extending substantially vertically upwardly, based on the primary working position of the hammer, wherein the gap discharges into the flue. The flue is thus provided at the end of the cooling air duct, between the gap and the opening, and intensifies the current effect in the cooling air duct and in the gap as a result of the heated air rising in the flue.

The flue may be formed as part of the hood. In particular, it is possible to produce the flue in one piece together with the hood.

The gap can run above the engine housing, the transmission housing, and/or the striking mechanism housing, at least in a sub-region, inclined to a horizontal. This means that the gap in the region above the respective housings should extend not only in a horizontal direction, but additionally in a vertical direction, wherein the gap should also rise at least slightly vertically in this region of substantially horizontal extent thereof. The gap should rise in particular in the direction of the opening in the hood or in the direction of the flue. Due to the convection current, a current effect can thus also be produced in the region above the housing as a result of the rising, heated air. Due to the at least slightly vertically rising gap, the hot air is able to flow further upwardly until it is ultimately released into the ambient environment via the flue and the opening. An accumulation of the heated cooling air above the housings is prevented with this design.

The gap above the housings in the direction of flow of the cooling air may accordingly run at least slightly upwardly in the vertical direction. A merely horizontal extent of the gap should be avoided, so as to prevent the aforementioned accumulation of heated cooling air. In principle however, (at least relatively short) horizontal regions of the gap are possible.

The gap can also be formed in such a way that it rises at an incline towards the opening, at least in sub-portions, even in a horizontal position of the drill hammer and/or impact hammer corresponding to an idle position.

In practice, it is normal for the hammer to be put down immediately in the idle position by the operator after use, so that the operator can carry out other tasks. For example, the idle position corresponds to a position rotated through 90 degrees in relation to the primary working position or operating position. Due to the specific design indicated herein, it is possible for the gap to have sub-portions which always run in a manner rising towards the opening, even in the intended idle position. A cooling air flow can thus also be produced in the idle position as a result of heated cooling air, which runs upwardly in the gap towards the opening. It is not necessary for the gap to rise at an incline or in a vertical manner over its entire extent. Rather, the portions of the gap also extending at least slightly in the vertical direction with a substantially horizontal extent, as specified above, particularly likewise rise upwardly at an incline in the horizontal idle position.

Since the gap runs at an incline in a sub-portion in the operating position or in the idle position, it must also rise at an incline in the respective other position, this position being rotated through 90° in relation to the former position.

In particular, the gap can be formed in such a way that it extends upwardly at an incline as far as the opening in the hood, above the housings, from a region of the drill hammer and/or impact hammer opposite the engine housing, based on the transmission housing. The transmission housing is arranged between the engine housing and the opposite region. It should be noted that the internal combustion engine is normally arranged on the side of the hammer facing away from the operator so that the operator himself, in relation to the intermediate transmission housing, stands in front of the region opposite the engine housing. The gap should run upwardly at an incline from this region until it reaches the opening in the hood or reaches the flue. The gap in particular also runs away from the operator so that the heated air in the gap is not guided over the operator.

Components which are sensitive to temperature can be arranged outside the hood. These include, in particular, a fuel tank or other fuel-guiding component parts, such as a fuel valve, part of a fuel hose, or a fuel filter. As mentioned above, there is the problem with conventional hammers that the hot device may lead to evaporation of fuel in the fuel system. The vapor bubbles produced thereby impair the start-up of the hammer considerably. Since the components involved with fuel storage and fuel feed are arranged outside the hood, they are also located outside the heated regions of the hammer. The cooling air duct provided between the hot components (in particular the various housings or sub-housings) and the fuel-guiding parts and the air current acting therein causes effective cooling, and therefore the components arranged outside the hood are hardly heated.

The tank can be arranged in an annular or U-shaped manner around the flue of the hood. This enables a space-saving arrangement of the tank and also the greatest possible effective length of the flue, which improves the cooling air current in the gap.

The hammer may additionally have a cooling air fan, which can be driven by the internal combustion engine and is known per se, for generating a cooling air flow, with which at least the cylinder of the internal combustion engine, but also other components, such as the exhaust gas system or the striking mechanism, can be cooled. The cooling air fan produces a forced convection current of the cooling air, which enables effective cooling during operation of the hammer.

Two separate cooling air flows are produced in cooperation between the active cooling by the cooling air fan and the cooling by free convection. The second cooling air flow, which is achieved by free convection, is designed in such a way that the temperature level is low enough to thermally decouple or cool the tank and the fuel-guiding component parts from the hot device during operation. The tendency for the formation of vapor bubbles in the fuel system is thus also reduced during operation and the reliability of the fuel system is thus improved.

In a variant, the hood is movable relative to the other components of the hammer, in particular relative to the engine housing, the transmission housing, and the striking mechanism housing. This movability causes a vibration decoupling, and therefore the hood, on which for example the handles for the operator may be provided, does not have to absorb completely the vibrations produced in the striking mechanism, in the engine, and in the transmission. The operator is thus relived of load when holding the hammer. The hood can be cushioned relative to the other components of the hammer so as to improve the vibration insulation.

The cross-section of the gap between the hood and the part surrounded thereby can be changed with the relative movement of the hood in relation to the part, at least in sub-regions of the gap. A pulsation, which, in addition to the above-described convection air current, also causes a further air current due to a pump effect, which superimposes the convective current, can thus be caused by the spring deflection of the hood.

The pump effect is produced by the spring deflection of the hood and by the oscillating relative movement of the hood in relation to the rest of the hammer.

The flue may taper conically upwardly and may be formed in such a way that the air can flow away upwardly through the large, conical cross-section in the event of spring deflection of the hood, but is no longer pushed back against the convection current. At the same time, the large volume of the flue acts in a homogenizing manner on the pulsing current so that the described convection current can develop.

These and further advantages and features will be explained in greater detail hereinafter on the basis of the example, with the aid of the accompanying figures.

BRIEF DESCRIPTION OF THE DRAWINGS

In the figures:

FIGS. 1 and 2 show different illustrations of a schematic example of a drill hammer and/or impact hammer according to the invention.

DETAILED DESCRIPTION OF THE PREFERRED EMBODIMENT

Figure 1:
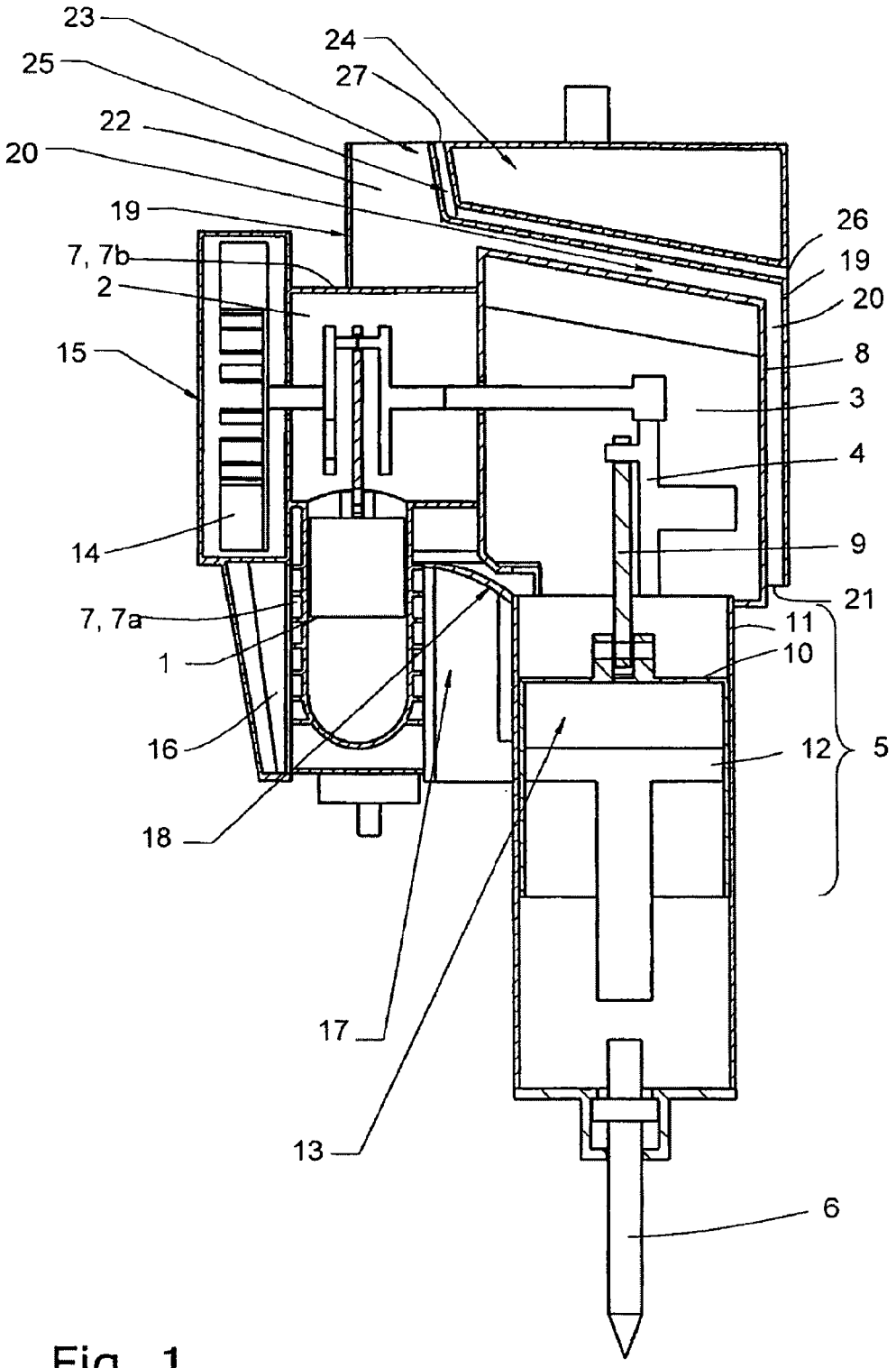
FIG. 1 shows a sectional illustration of a hammer.

The hammer has an internal combustion engine 1, which drives a striking mechanism 5 via a first crank drive 2, a transmission 3, and a second crank drive 4. The striking mechanism 5 in turn acts on a tool 6, in the present example a drill bit. Many designs of a hammer of this type are known and therefore do not have to be explained in detail.

The internal combustion engine 1 is surrounded by an engine housing 7. The expression "engine housing" is selected comprehensively herein as an all-encompassing expression. Of course, the engine housing 7 may also comprise a plurality of sub-housing components, that is to say for example a cylinder housing 7*a* and a crank housing 7*b*. The crank housing 7*b* surrounds the first crank drive 2.

The transmission 3 is surrounded by a transmission housing 8, which also receives the second crank drive 4.

The striking mechanism 5 is formed as a pneumatic spring striking mechanism and has a connecting rod 9, which is moved by the second crank drive 4 and which moves a drive piston 10 up and down in a striking mechanism housing 11 serving as a guide housing.

A percussion piston 12 is guided inside the drive piston 10 and moves against the end of the tool 6 and is guided back again via a pneumatic spring 13 formed between the drive piston 10 and the percussion piston 12. The function of a striking tool 5 of this type is also known and does not have to be discussed in greater detail at this juncture.

A cooling air fan 14 with a cooling air inlet 15 is arranged at the end face of the first crank drive 2. The cooling air fan 14 is driven in rotation by the crankshaft of the first crank drive 2 and sucks up ambient air via the cooling air inlet 15. The cooling air is then guided via a cooling air duct 16 to the components of the hammer to be cooled.

In particular, the cooling air duct 16 guides the cooling air to an outer wall of the cylinder housing 7*a*. The cooling air can then still be used to cool an exhaust gas system 17 or the striking mechanism housing 11. The striking mechanism housing 11 should be cooled in particular in the region of the pneumatic spring 13, because this is where high temperatures may prevail due to the air compression.

A baffle plate 18 is provided inter alia to guide the cooling air flow generated by the cooling air fan 14.

In this regard, the design and cooling function with the aid of forced cooling of this type is known from the prior art.

With the hammer according to the invention, a hood 19 is arranged in the upper region and surrounds the components to be cooled, at least in part. In the example shown, the hood 19 encloses part of the engine housing 7 and a considerable part of the transmission housing 8 in a tent-like manner. The striking mechanism housing 11 is not surrounded by the hood 19. However, it is easily conceivable that the hood 19 could also extend further downwards so as to also enclose at least part of the striking mechanism housing 11.

The hood is arranged at a distance from the parts surrounded thereby so that a gap 20 is formed between the hood 19 and the housing components 7, 8.

In the example shown in FIG. 1, it can be seen that the gap 20, based on a vertical working direction of the hammer, has an inlet 21 in its lower side, said inlet initially extending vertically along the housing components 7, 8 and ultimately discharging into a flue 22. The flue 22 ends at an upper side of the hood 19 in the form of an opening 23.

If, during operation, the housing components 7, 8 are heated, the air in the gap 20 is also heated. The air in the gap 20 thus flows upwardly and may ultimately emerge from the gap 20 via the opening 23. The rising effect is intensified by the flue 22, which can be seen clearly in particular in FIG. 2.

Due to the rising cooling air in the gap 20, a vacuum is produced at the lower side at the inlet 21, and therefore cool ambient air can flow into the gap 20 via the inlet 21. A cooling air current caused by free convection is thus produced in the gap 20 and cools the outer side of the housing walls.

The cooling air flow is also maintained if the operation of the hammer is abandoned and the internal combustion engine 1 is switched off. The engine components, transmission components, and striking mechanism components, which are still hot, also heat the air in the gap 20, and therefore the cooling air flow is maintained.

The flue 22 is conical, thus intensifying the flue effect. In addition, the flue is arranged on the upper side of the tent-like hood 19 at the highest point, more specifically both if the hammer stands in the vertical position provided for operation and if the hammer is put down and thus adopts a horizontal position.

The flue 22 may also have an upwardly inclined course extending away from the operator. In addition, transverse ribs or transverse walls may be used in the flue 22 to stabilize the flue 22. In this case, the opening 23 may be formed as a plurality of cooling slits, which are provided at the upper end of the flue 22.

The inlet in the flue 22 in the lower side thereof or at the transition between the gap 20 and the flue 22 can be rounded and conical so as to introduce the air current into the flue with as little resistance as possible.

By contrast, the outlet in the flue 22 is formed in an angular manner at the opening 23 so that the air is prevented from flowing back into the flue 22 from the outside.

This design may be advantageous in particular if the hood 19 is mounted in a resiliently movable manner in relation to the other components of the hammer. A resilient movability of this type is desired so as to achieve vibration insulation between the hood 19, generally also carrying handles for the operator, and the rest of the hammer, which is subjected to intense vibration.

It is known from DE 20 2004 006 553 U1 that a pump effect can be produced between the hood and the rest of the components of the hammer due to the relative movement thus possible. This pump effect can also be used in the present case to assist the convection current and to superimpose an additional pump current. Due to the described design of the flue, the pump current is conveyed in one direction, namely from bottom to top. An opposed current direction is prevented, and therefore the design of the flue achieves a similar effect to a check valve.

For example, it has been found that suitable dimensions for the flue 22 include a length of the flue opening at the lower side of 90 mm and a width between 40 and 60 mm. At the upper side, the length may be 65 mm and the width may be between 20 and 35 mm. The height should be at least 25 mm. A flue height of up to 80 mm is particularly suitable. If the flue is inclined forwards in relation to the horizontal, the height may be 26 mm at the front side for example, and 77 mm at the rear side.

A tank 24, in which the fuel for the hammer is stored, is arranged above the hood 19. Other fuel-guiding components (not illustrated in the figure), such as a fuel valve, a fuel filter, etc., can equally be arranged outside the hood 19.

The tank 24 is arranged at a distance above the hood 19 so that a further air gap 25 is formed between the hood 19 and the tank 24. The air gap 25 causes additional thermal insulation, and therefore the tank 24 may be hardly heated by the hot components inside the hammer. In addition, a convection current similar to that in the gap 20 can be produced in the air gap 25. For this purpose, the air gap 25 can be open towards the ambient environment via an inlet 26 and an outlet 27. The inlet 26 and the outlet 27 may each extend as slits along the air gap 25.

Figure 2:
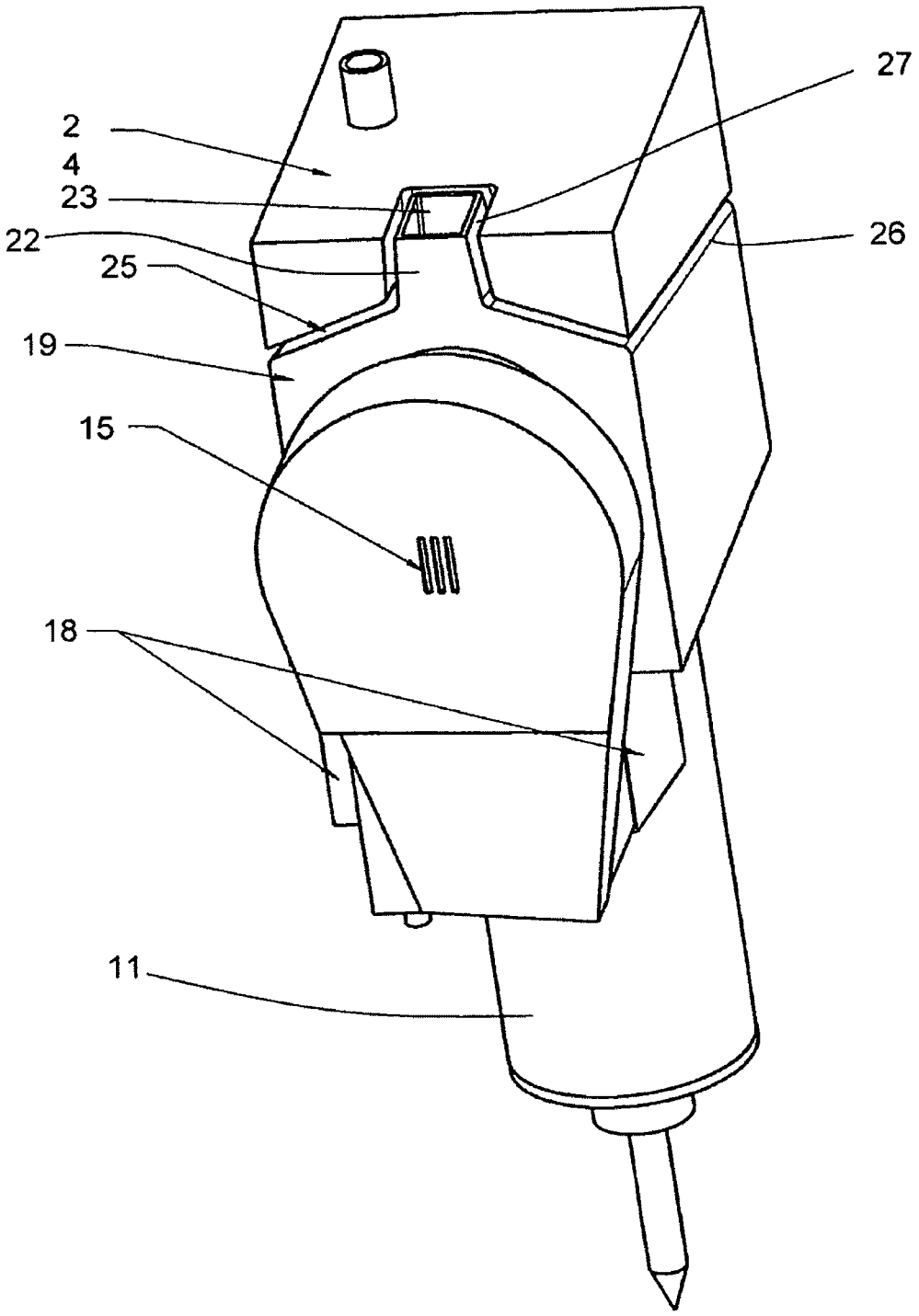
FIG. 2 shows a perspective view of the hammer.

The gap 25 runs in a u-shaped manner around the flue 22 at the outlet 27, as shown in FIG. 2.

The gap 20 extends laterally vertically from the housings 7, 8 of the sub-components. The gap 20 rises at an incline towards the flue 22 above the housing components, in particular above the transmission housing 8. The inclined rise of the gap 20 can also be seen clearly in FIG. 2.

Due to the course, inclined to a horizontal plane, above at least the transmission housing 8, it is possible to achieve a reliable convection current, even in a region in which a substantially horizontal air current of the cooling air has to be provided, due to the at least slight rise as a result of the inclined position of the gap 20.

FIG. 1 thus shows the inclined course of the gap 20 above the transmission housing 8, whilst the inclined course of the gap 20, corresponding to the upper side of the hood 19, can be seen clearly in FIG. 2.

The inclined course of the gap 20 above the transmission housing 8 has a further advantage, as will be explained hereinafter. According to experience, a hammer is switched off immediately once work is complete and is conventionally put down on the rear side. The side opposite the internal combustion engine in relation to the transmission 3 and the striking mechanism 5 is understood to mean the rear side, that is to say the right-hand side of the hood 19 in FIG. 1, which is not visible in FIG. 2. The hammer is normally held by an operator, standing on the rear side, by handles (not illustrated in the figures).

When the hammer is put down on the rear side, the region of the gap 20, which is provide above the transmission housing 8 in the working position, runs substantially vertically towards the then horizontally aligned flue 22. An air current, which cools the components, is thus also produced in the gap 20. The hammer can therefore also be cooled by free convection in the horizontal idle position.

The tank 24 surrounds the flue 22 in a U-shaped manner, as shown in FIG. 2. The installation space can thus be utilized effectively. It is likewise possible to position the flue 22 slightly closer to the center, above the shaft of the tool 6, and to arrange the tank 24 annularly around the flue 22.

The invention claimed is:

1. A percussion tool, comprising:

an internal combustion engine with an engine housing;

a striking mechanism which is driven by the internal combustion engine and which has a striking mechanism housing;

a transmission which is arranged operatively between the internal combustion engine and the striking mechanism and which has a transmission housing;

a cooling air fan which is driven by the internal combustion engine, for generating a cooling air flow, and via which at least one cylinder of the internal combustion engine is cooled; and a hood surrounding at least part of at least one of the engine housing, the transmission housing, and the striking mechanism housing in a region; wherein the region is defined by the hood surrounding a part comprising at least a portion of at least one of the engine housing, the transmission housing, and the striking mechanism housing;

the hood is spaced from the part which it surrounds in such a way that a gap is provided between the part and the hood;

the gap is open at its lower side towards the ambient environment, based on a primary working direction of the percussion tool;

the hood has an opening in its upper side;

the gap and the opening are communicatively interconnected and form a cooling air duct, in such a way that ambient air can flow in via the lower side in the form of cooling air and can flow out again via the opening; and wherein separate flow paths are formed within the percussion tool for the cooling air flow produced by the cooling air fan and the cooling air flowing through the gap, the separate air flow paths forming separate cooling air flows that do not mix with one another within the percussion tool.

2. The percussion tool as claimed in claim 1, wherein the hood surrounds the region in a tent-like manner.

3. The percussion tool as claimed in claim 1, wherein the opening provided in the upper side of the hood is formed at the end of a flue extending substantially vertically; and wherein the gap discharges into the flue.

4. The percussion tool as claimed in claim 3, wherein the flue is part of the hood.

5. The percussion tool as claimed in claim 3, wherein a tank is arranged around the flue of the hood at least one of annularly and in a U-shaped manner.

6. The percussion tool as claimed in claim 1, wherein the gap runs above at least one of the engine housing, the transmission housing, and the striking mechanism housing, at least in a sub-region that is inclined to a horizontal.

7. The percussion tool as claimed in claim 1, wherein, at least a region of the gap which extends substantially horizontally above at least one of the engine housing, the transmission housing, and the striking mechanism housing, additionally has a direction of extension directed in the vertical direction; and wherein the gap also rises at least slightly in the region of its substantially horizontal extension in a direction of a flue.

8. The percussion tool as claimed in claim 1, wherein the gap runs above at least one of the engine housing, the transmission housing, and the striking mechanism housing, at least in a sub-region that is extends at least slightly upwardly in the vertical direction in the direction of flow of the cooling air.

9. The percussion tool as claimed in claim 1, wherein the gap is formed in such a way that it rises at an incline towards the opening, at least in a sub-portion, even in a horizontal position of the percussion tool corresponding to an idle position.

10. The percussion tool as claimed in claim 1, wherein the gap is formed in such a way that it extends upwardly at an incline as far as the opening in the hood and above at least one of the engine housing, the transmission housing, and the striking mechanism housing, from a region of the percussion tool opposite the engine housing, wherein the transmission housing is arranged between the engine housing and the opposite region.

11. The percussion tool as claimed in claim 1, wherein the gap extends upwardly at an incline, away from an operator when operating the percussion tool, as far as the opening in the hood, and above at least one of the engine housing and the transmission housing, from a region of the percussion tool lying closest to a standing position of an operator while holding a handle of and controlling the percussion tool.

12. The percussion tool as claimed in claim 1, wherein at least one of a tank and fuel-guiding component parts are arranged outside the hood.

13. The percussion tool as claimed in claim 12, wherein a further gap is provided between the hood and the at least one of the tank and the fuel-guiding component parts.

14. The percussion tool as recited in claim 12, wherein the fuel-guiding component parts include at least one of a fuel valve, a fuel hose, and a fuel filter.

15. The percussion tool as claimed in claim 1, wherein the hood is movable relative to the part which it surrounds; and wherein the cross-section of the gap can be changed, at least in sub-regions of the gap, if the hood is moved relative to the part which it surrounds.

* * * * *